US005223813A

United States Patent [19]

Cambreleng et al.

[11] Patent Number: 5,223,813

[45] Date of Patent: Jun. 29, 1993

[54] CIRCUIT BREAKER ROCKER ACTUATOR SWITCH

[75] Inventors: Paul Cambreleng; Karl R. Kropp, both of Evansville, Ind.

[73] Assignee: Potter & Brumfield, Inc., Princeton, Ind.

[21] Appl. No.: 792,523

[22] Filed: Nov. 18, 1991

[51] Int. Cl.[5] ..... H01H 71/16

[52] U.S. Cl. ..... 337/66; 337/70; 200/336; 200/339

[58] Field of Search ..... 337/66, 58, 59, 70, 337/71, 72, 73; 200/339, 336

[56] References Cited

U.S. PATENT DOCUMENTS

| | | | |
|---|---|---|---|
| 2,160,236 | 5/1939 | Taylor . | |
| 3,840,833 | 10/1974 | Mrenna et al. | 337/43 |
| 4,044,325 | 8/1977 | Krasser et al. | 337/66 |
| 4,079,345 | 3/1978 | Pietsch | 335/10 |
| 4,091,351 | 5/1978 | Flory et al. | 337/62 |
| 4,167,720 | 9/1979 | Krasser | 337/60 |
| 4,206,430 | 6/1980 | Rusch et al. | 335/28 |
| 4,329,669 | 5/1982 | Krasser et al. | 335/20 |
| 4,516,098 | 5/1985 | Krasser et al. | 335/35 |
| 4,570,142 | 2/1986 | Ineichen et al. | 337/66 |
| 4,931,762 | 6/1990 | Fierro | 337/66 |
| 4,937,548 | 6/1990 | Sdunek | 337/70 |

FOREIGN PATENT DOCUMENTS

| | | |
|---|---|---|
| 0963045 | 2/1975 | Canada . |
| 2502579 | 7/1976 | Fed. Rep. of Germany . |

*Primary Examiner*—Harold Broome
*Attorney, Agent, or Firm*—Joseph S. Codispoti

[57] ABSTRACT

A rocker actuator switch having a frame which has a first projection extending therefrom which passes through a yoke portion of a rocker actuator that moves between on and off positions. The rocker actuator is pivotally connected to the frame by a snapping arrangement whereby a second frame projection is guided and slides along a flexible cantilevered beam, which is disposed in a sidewall of the rocker actuator, until the second projection enters a partial circular cutout in the sidewall of the rocker actuator. Upon entering the cutout, the flexible beam retains the second projection in the cutout where it is free to pivot.

20 Claims, 7 Drawing Sheets

CIRCUIT BREAKER ROCKER ACTUATOR SWITCH

BACKGROUND OF THE INVENTION

1. Field of the Invention

This invention relates to a two pole circuit breaker with a common trip mechanism, and more particularly to a circuit breaker having a unique rocker actuator switch which is used to turn the circuit breaker on and off.

2. Description of the Related Art

Two pole circuit breakers, such as that disclosed in U.S. Pat. No. 4,931,762, generally employ a rocker handle which is rotatably supported to a frame by a pin. Additionally, the rocker handle has a linkage crank arm which is connected to a linkage member by pins, the linkage member also being connected to a rocker by pins. The rocker itself is supported in the frame by a pin which is transversely movable in a guide slot in the frame. The problem with conventional rocker actuator switches is that the use of guide pins, rivets, screws, or other fasteners to connect all of the moving parts together makes assembly difficult and requires the manufacture of extra parts while increasing the cost of the circuit breaker.

Moreover U.S. Pat. No. 4,931,762 discloses a spring positioned between the frame and the linkage crank arm which is used to bias the rocker actuator switch into the off position. However, the spring is unguided, and therefore over an extended period of use it may be prone to buckling which would result in an insufficient amount of force being generated to turn the actuator switch off.

SUMMARY OF THE INVENTION

It is an object of the present invention to provide a rocker actuator switch which eliminates the need for using pins or other fasteners to connect the associated movable parts.

It is also an object of the invention to provide a rocker actuator switch which is self supporting on the frame.

It is also an object of the invention to provide a rocker actuator switch which is easily placed in the frame and which is self-guiding, and self-aligning.

Still another object of the invention is to provide a rocker actuator switch which retains and guides a n electrically isolated rocker return spring between the frame and the rocker actuator.

The above objects are accomplished by providing a rocker actuator switch having a frame which has a first projection extending therefrom which passes through a yoke portion of a rocker actuator that moves between on and off positions. The rocker actuator is pivotally connected to the frame by a snapping arrangement whereby a second frame projection is guided and slides along a flexible cantilevered beam, which is disposed in a sidewall of the rocker actuator, until the second projection enters a partial circular cutout in the sidewall of the rocker actuator. Upon entering the cutout, the flexible beam retains the second projection in the cutout allowing the rocker actuator to pivot about the second projections.

BRIEF DESCRIPTION OF THE DRAWINGS

Other objects, features, and advantages of the present invention will become apparent from the following detailed description and the accompanying drawings wherein.

DETAILED DESCRIPTION OF THE PREFERRED EMBODIMENTS

Figure 1:
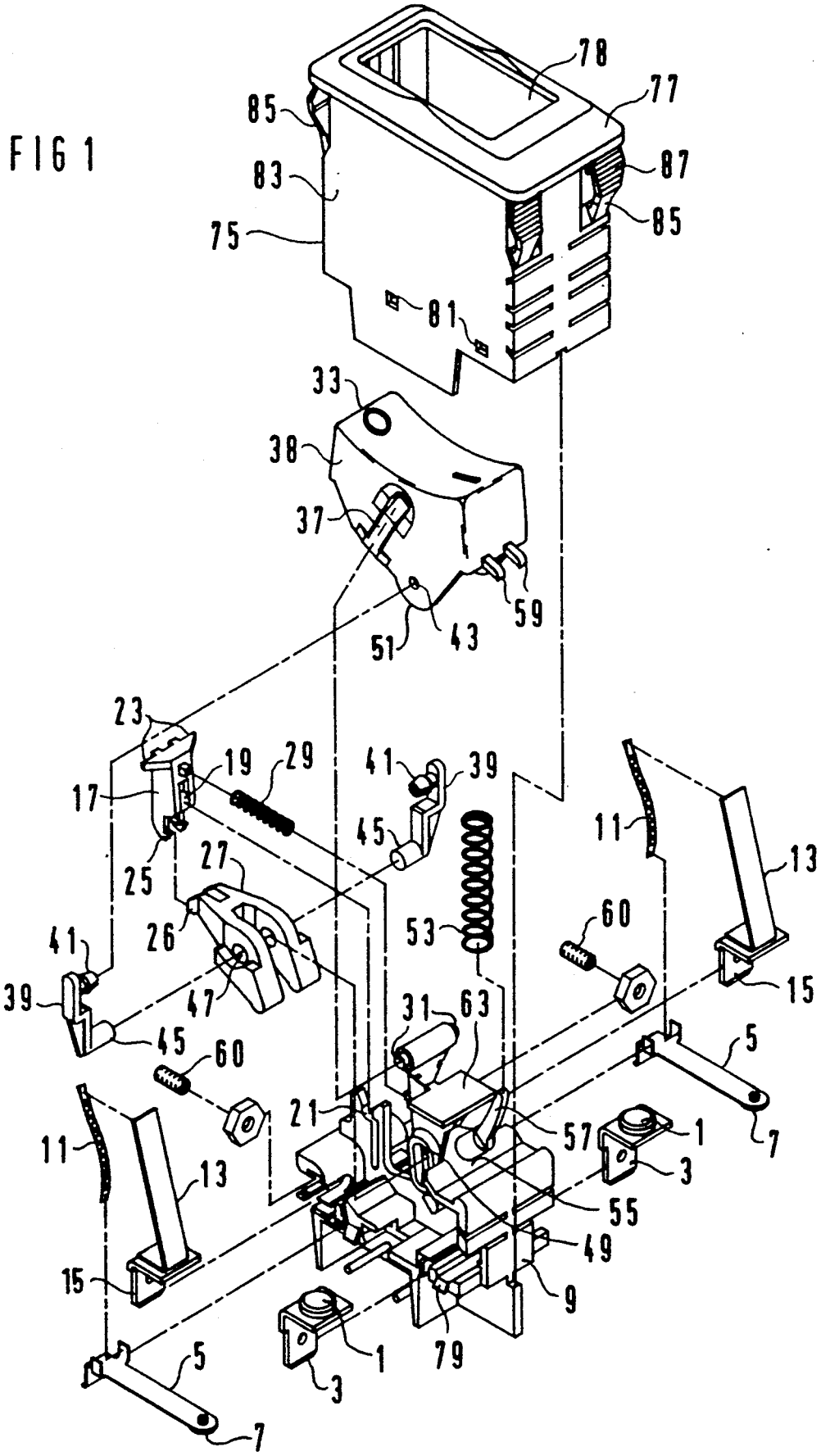
FIG. 1 is an exploded view of a two pole circuit breaker incorporating the inventive rocker actuator switch.
Figure 2:
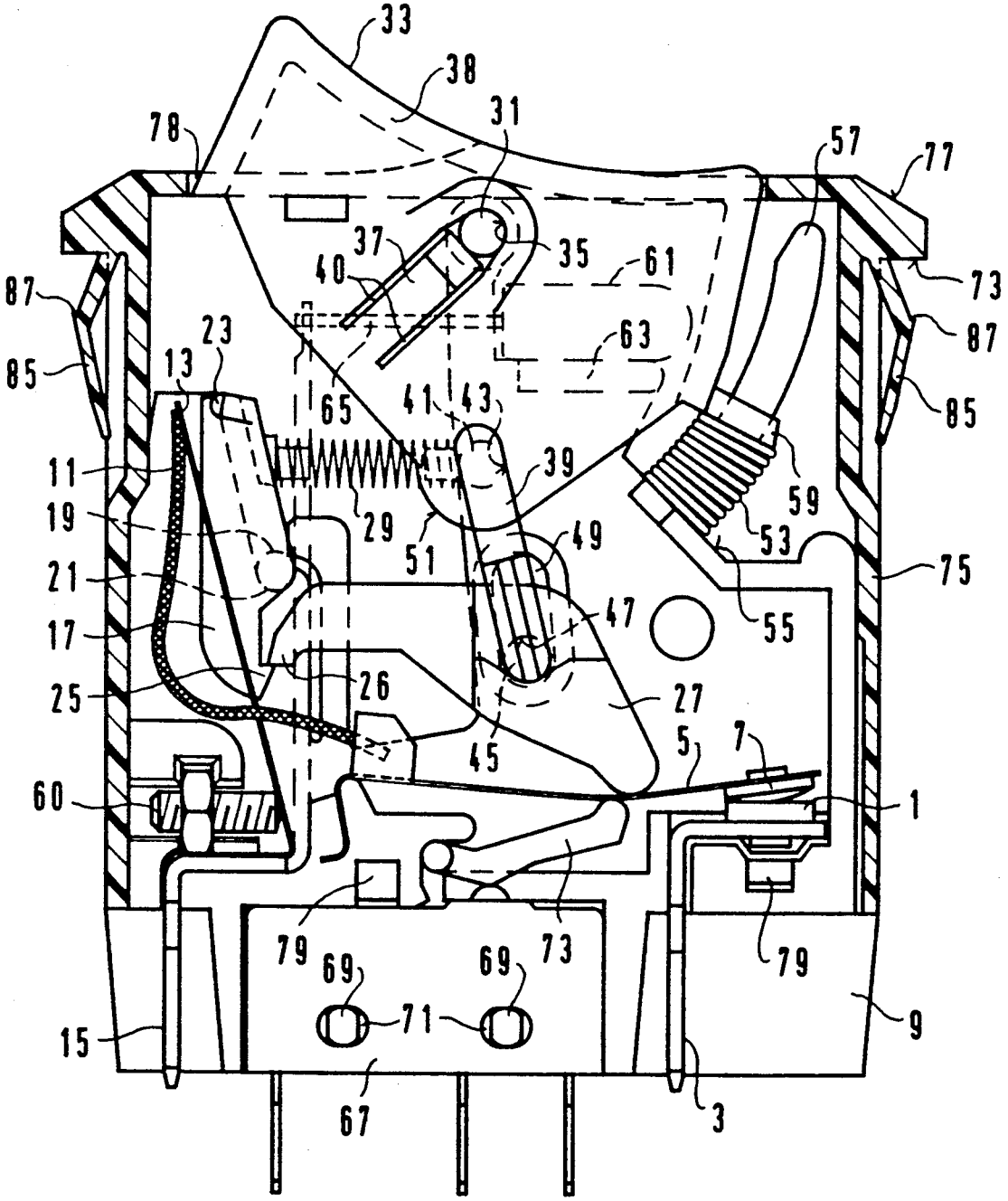
FIG. 2 is a vertical cross section of a two pole circuit breaker incorporating the rocker actuator switch.

Referring to FIGS. 1 and 2, the internal components of a two pole circuit breaker are shown. The circuit components consist of stationary contact members 1 which are integral with and perpendicular to line terminals 3. Flexible metal cantilever springs 5 each have a contact member 7 secured at a free end thereof. Each cantilever spring 5 is connected at its opposite end to the circuit breaker frame 9 in a conventional manner. In its free position, the cantilever spring 5 will separate contact member 7 above and away from stationary contact member 1, thereby creating an open circuit.

Flexible conductors 11 are secured, at one end, close to the point where the cantilever springs 5 are connected to the frame 9. The area securing each flexible conductor 11 may be a portion of spring material turned at an angle from the area where the cantilever springs 5 are connected. Each flexible conductor 11 is secured at its opposite end to one end of a respective bimetal beam 13, which is made from two or more metal materials. The metal materials have different coefficients of thermal expansion. The opposite ends of the bimetal beams 13 are connected at an angle to respective load terminal members 15. Both the bimetal beams 13 and load terminal members 15 are interlocked with the frame 9 such that the load terminal members 15 project through the bottom of frame 9. Thus, due to the aforementioned structure, when either of the bimetal beams 13 is heated, as for example during an overload condition, the differences between the thermal coefficient of the bimetal beam 13 materials will force the free end of the heated bimetal beam 13 to bend or move in an arc-like manner.

Directly adjacent to and spaced from the bimetal beams 13 is a common trip 17. Common trip 17 has a cylindrical surface 19 which is designed to snap into a partial circular opening 21 in frame 9. The partial circular opening 21 extends through an arc of more than 180° and has an opening which is equal to the diameter of the cylindrical surface 19. Since the gap of the partial circular opening 21 and the cylindrical surface is equal, an interference between parts is established such that the cylindrical surface 19 needs to be pushed or snapped into the circular opening 21. Circular opening 21 initially enlarges to receive the cylindrical surface 19 and then returns to its original position, thereby retaining the cylindrical surface 19 in place while allowing it to pivot freely within the circular opening 21. Therefore, when the common trip 17 is subjected to an external force, it is free to pivot via the cylindrical surface 19.

Common trip 17 also has an upper portion 23 and a lower portion 25. The lower portion 25 engages and disengages with a latch portion 26 of a cam member 27, which will be described later. The upper portion 23 is designed to engage with the bimetal beams 13 when the bimetal beams 13 are heated and subsequently bend toward upper portion 23. The force exerted by the bimetal beams 13 on the upper portion 23 causes the common trip 17 to pivot within the circular opening 21. When the force exerted by the bimetal beams 13 is no longer present (when the bimetal beams cool and return to their initial state), the common trip 17 holds its position until it is manually or electrically tripped at which time a compression spring 29 returns the common trip 17 to its original position. The compression spring 29 is disposed and held in place between frame 9 and upper portion 23 in a conventional manner.

Figure 3:
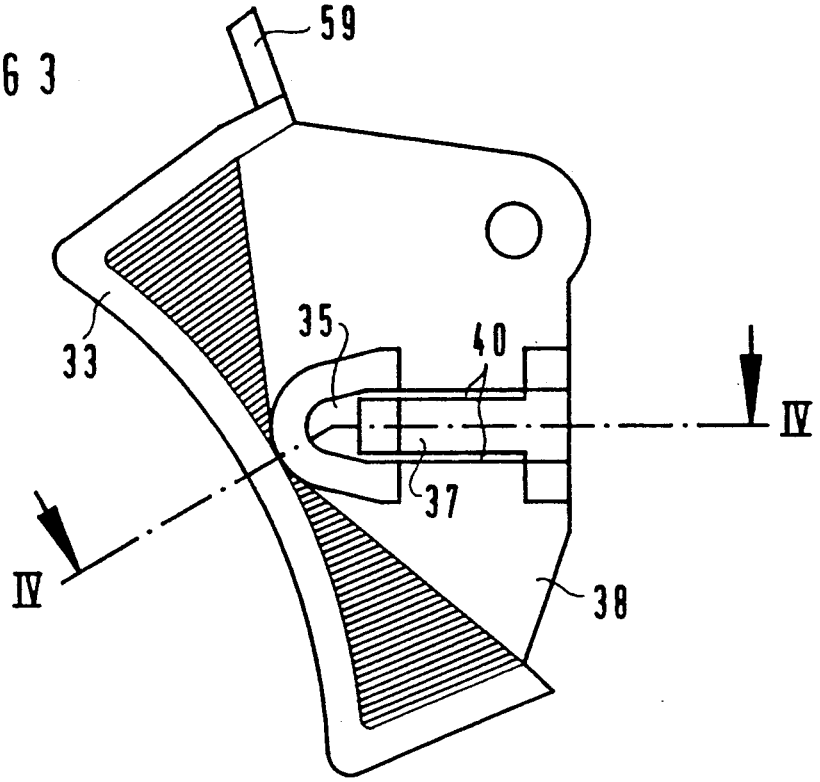
FIG. 3 is a detailed side view of the rocker actuator snapping arrangement.
Figure 4:
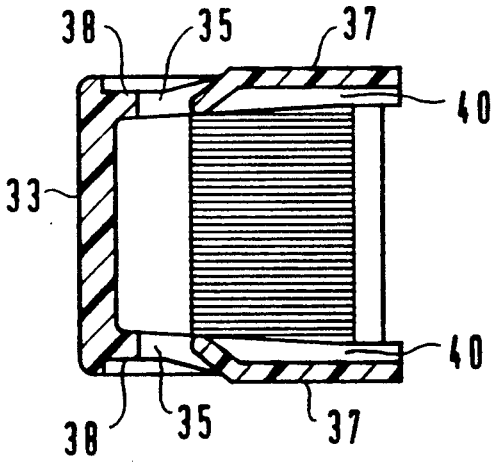
FIG. 4 is a view as taken along IV—IV of FIG. 3.

Frame 9 has a pair of cylindrical extensions 31 upon which a rocker actuator 33 snaps into place. Once the rocker actuator 33 is snapped in place, the cylindrical extensions 31 act as a fulcrum point for the rocker actuator 33 allowing it to move between on and off positions. In order to accomplish the snapping engagement of the rocker actuator 33 and the cylindrical extensions 31, the rocker actuator 33 has a pair of partial circular cutouts 35 in the sidewalls 38 thereof. The partial circular cutouts 35 each have an open end into which a flexible cantilevered beam 37 extends thereby closing the partial circular cutouts 35. The flexible cantilevered beam 37 is formed by a slot in the rocker actuator sidewalls 38 thereby forming the flexible cantilevered beams 37 which can flex when passing over the cylindrical extensions 31. On the internal surface of sidewalls 38, a groove 40 is formed which guides the rocker actuator 33 as it is pushed onto the frame 9. As rocker actuator 33 is pushed onto frame 9, cylindrical extensions 31 pass within groove 40 forcing the flexible beam 37 to flex outward to receive the cylindrical extensions 31 until the cylindrical extensions 31 are guided into respective partial circular cutouts 35. The flexible beams 37 then snap back into place retaining the cylindrical extensions 31 within the circular cutouts 35 and thereby provide bearing surfaces for the cylindrical extensions 31 as the rocker actuator pivots around them while moving between the on and off positions. Accordingly, the mounting of the rocker actuator 33 on the frame 9 is accomplished simply and accurately without requiring the use of pins, rivets, screws or other fasteners. The rocker actuator 33 is a single molded piece made from opaque or transparent plastic. FIGS. 3 and 4 provide a detailed view of the snapping arrangement.

Rocker links 39 connect rocker actuator 33 to cam member 27. Rocker links 39 each have a cylindrical tapered split projection 41 at one end thereof which projects through a corresponding circular opening 43 in rocker actuator 33. Thus, when the projections 41 are forced into openings 43, the split portions of the projections 41 are forced toward each other. However, once inserted, the split portions spring apart thereby creating an outward force against the walls of openings 43 which retains the projections 41 in place while allowing the rocker links 39 to pivot relative to rocker actuator 33.

Rocker links 39 each have a second cylindrical projection 45 which is located at an opposite end from the split cylindrical projection 41. Cylindrical projections 45 pass through respective openings 47 in cam member 27 and into a slot 49 in frame 9. The movement of cylindrical projections 45 within slot 49 creates a path which actuates the switching portion of the circuit breaker. Additionally, cylindrical projections 45 act as fulcrum points for cam member 27. Moreover, rocker links 39 may have an offset portion (not shown), at a fixed distance from cylindrical split projection 41, which will bear on the radiused surface 51 of rocker actuator 33.

In order to bias rocker actuator 33 toward the off position, a spring 53 is disposed between the rocker actuator and the frame 9. More specifically, frame 9 has a spring seat 55 having a curved projection 57 extending upward therefrom. Spring 53 slides over curved projection 57 and rests against spring seat 55. Correspondingly, rocker actuator 33 has a yoke portion 59 which extends from one end thereof. Curved projection 57 passes through yoke portion 59 providing a guide for the rocker actuator 33 as it is moved between the on and off positions. Additionally, yoke portion 59 serves as an upper spring seat for spring 53. Therefore, yoke portion 59 and curved projection 57 are used to guide and center the rocker actuator 33 during its initial installation, and are subsequently used to retain the spring 53 in place. Yoke portion 59 can also have a boss (not shown) on its bottom side which would fit within spring 53 to help provide stability to the guiding control.

The circuit breaker also has a pair of adjusting screws 60 which each correspond to a respective one of said bimetal beams 13. The distance between the bimetal beams 13 and the common trip 17 determines how much the bimetal beams have to bend in order to contact common trip 17. The amount that the bimetal beams 13 bend is a function of the current applied to them. Accordingly, by using the adjusting screws to set the angular distance between the bimetal beams 13 and the common trip 17, the distance required for an overload condition can be adjusted.

The circuit breaker rocker actuator switch may also include a miniature lamp 61 which is situated on a shelf 63 within frame 9. Leadwires 65 connect the miniature lamp to the load terminal 15. One of the leadwires 65 may have a resistor (not shown) connected thereto for controlling the current draw.

An optional auxiliary switch 67 can be mounted in the frame 9 by the insertion of frame projecting cylindrical parts 69 into mounting holes 71 in auxiliary switch 67. Frame 9 contains the auxiliary switch 67 on three sides. A lever 73, that is captivated in frame 9, operates auxiliary switch 67 when it moves in response to a movement of cantilever springs 5 during the switching of the rocker actuator 33 into the on and off positions.

A cover 75 has a top flange portion 77 with a rectangular opening 78 through which rocker actuator 33 projects. Cover 75 is open on the bottom so that the entire circuit breaker mechanism can be inserted into cover 75. Cover 75 is secured in place by the engagement of inclined plane projections 79 with corresponding openings 81 in sidewall 83 of cover 75. Additionally, the cover 75 is secured in place by stops created by mating parts of the frame 9 and cover 75.

Cover 75 also has a snap in mounting feature which allows the cover to engage with a remote panel (not shown). The snap in mounting feature consists of flexible projections 85, which extend from flange portion 73, and which have saw teeth slots 87 that engage behind flange portions of a circuit panel. The flexible projections 85 could alternatively extend past the circuit breaker width to assist in centering the circuit breaker in the circuit breaker panel.

To better understand the operation of the circuit breaker, reference will be made to FIGS. 5, 6, 7, and 8.

Figure 5:
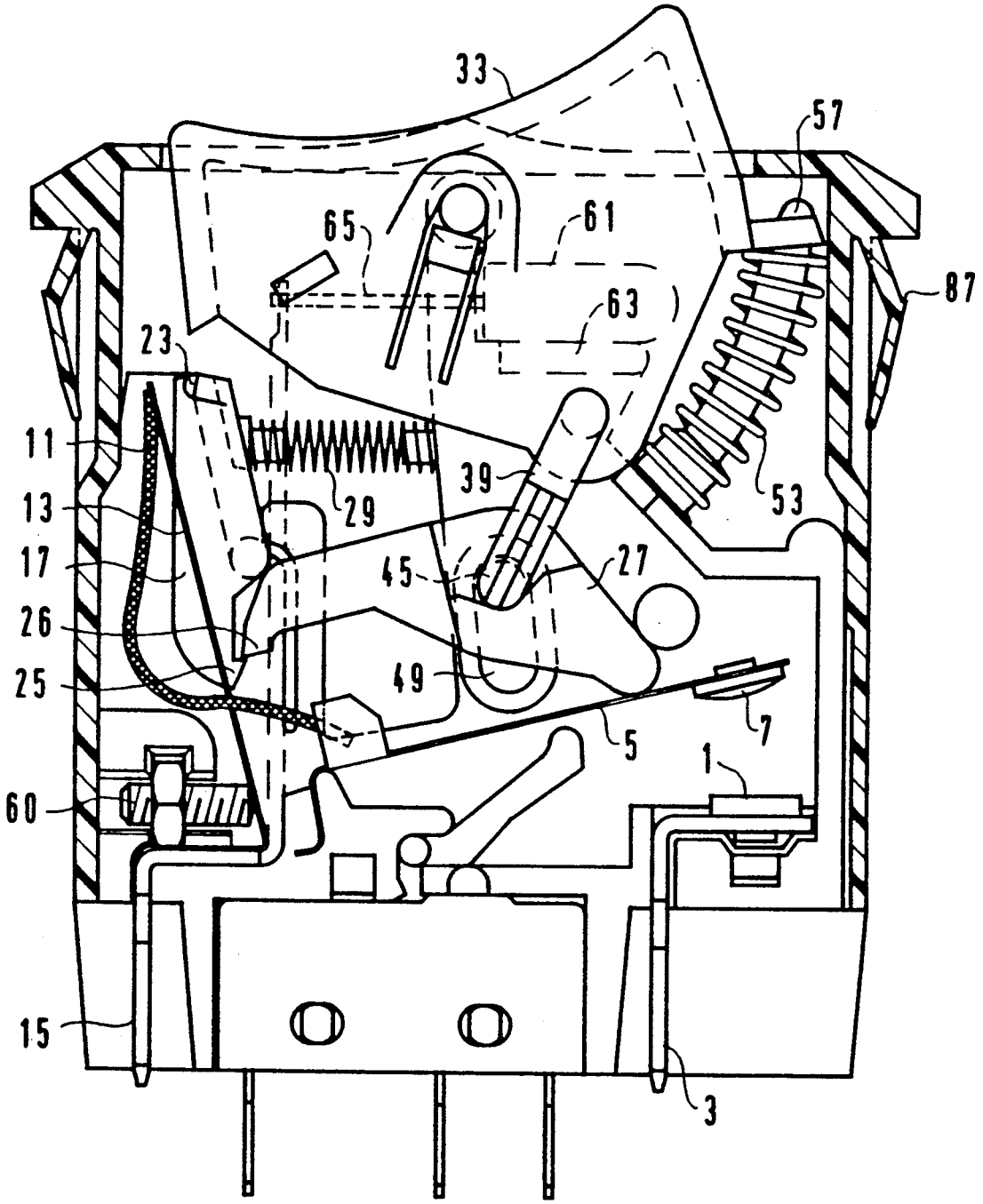
FIG. 5 shows a side view of the two pole circuit breaker in an open position.

FIG. 5 shows the circuit breaker components in the "off or open position". This position occurs when the rocker actuator 33 is manually placed in this position or when the circuit breaker is tripped through the heating and movement of one of the bimetal beams 13 against the common trip 17, and subsequently the common trip 17 is returned to its normal position by the compression spring 53 after the bimetal beam cools. The cantilever springs 5 are in the open position, such that the cylindrical projections 45 are in the upper portion of the guiding slot 49 and the latch portion 26 of cam member 27 is in a position to engage with the lower portion 25 of the common trip member 17. All parts are held in position by the rocker return spring 53.

Figure 6:
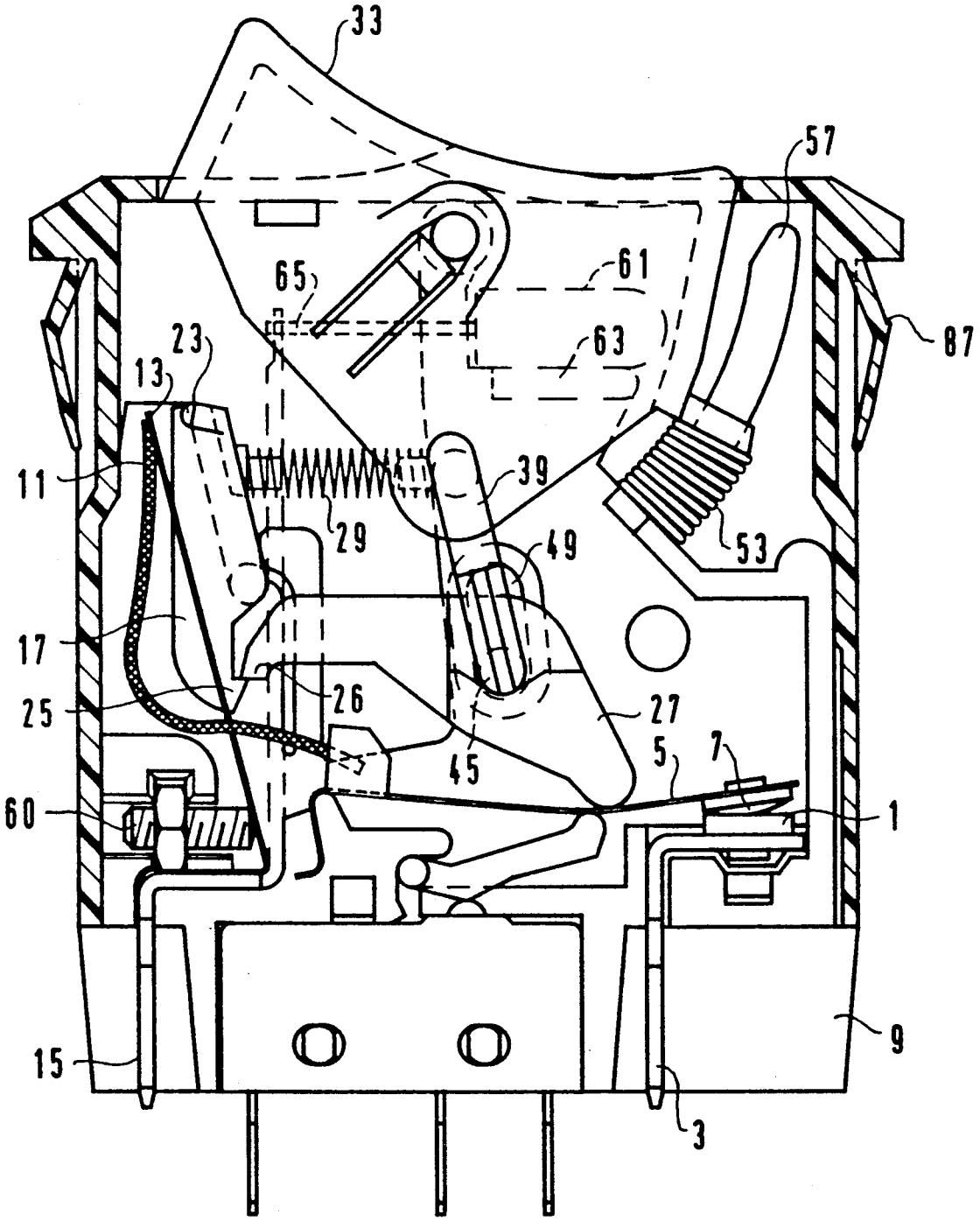
FIG. 6 shows a side view of the components of the two pole circuit breaker in a closed position.

FIG. 6 shows the circuit breaker in the "on position". The rocker actuator 33 is depressed to the "on position" which moves one end of the rocker link 39 through an arc to a position that is over center with the guided position of the other end of the rocker link cylindrical projection 45. The lower section of the common trip 17 is engaged with the latch portion 26 of the cam member 27 which causes the cam member 27 to depress the cantilever springs 5 into the conducting position completing the circuits and allowing current to flow from the stationary current member 1 through contact member 7, cantilever spring 5, flexible conductor 11, bimetal beam 13, and into load terminal 15.

Figure 7:
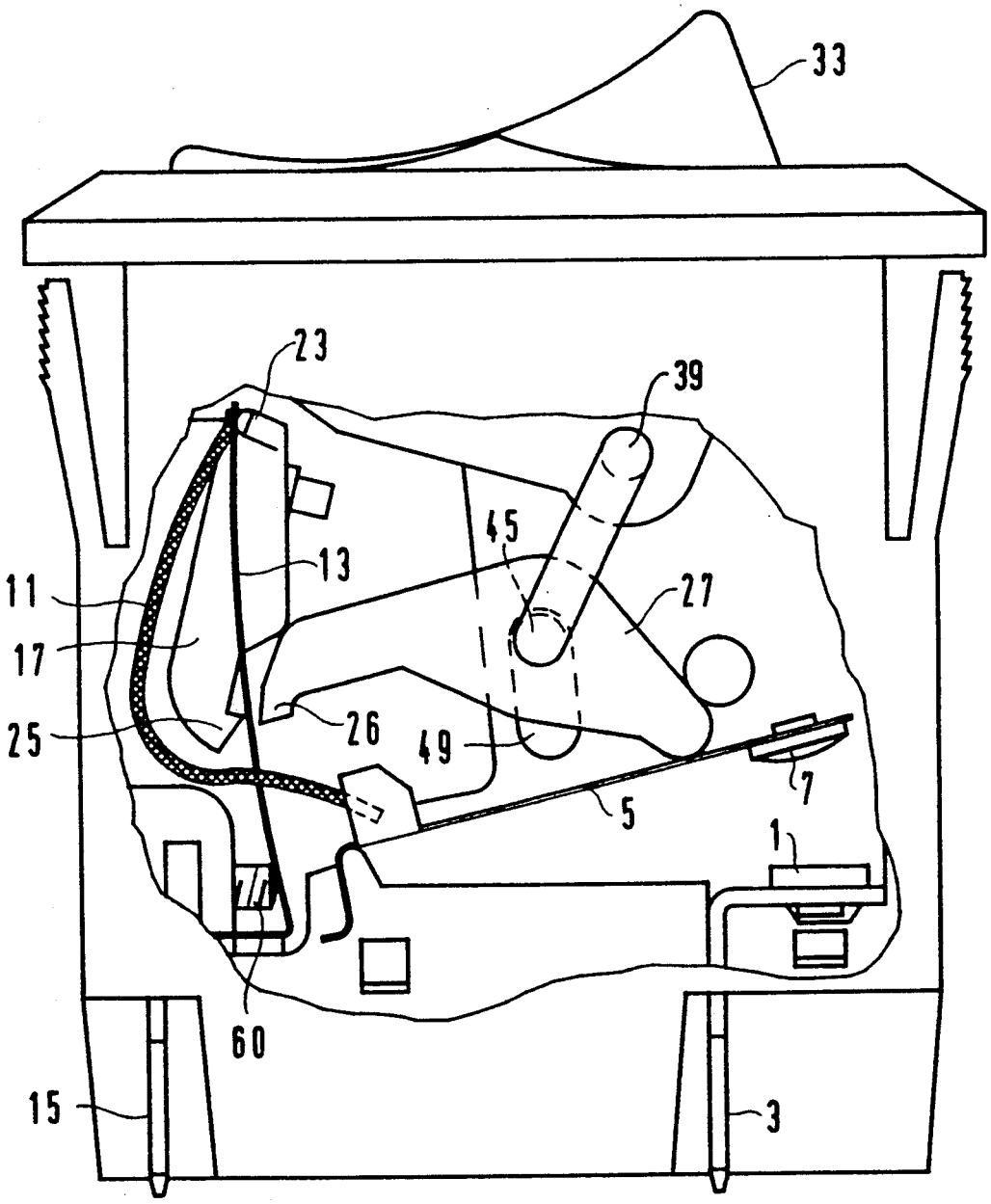
FIG. 7 schematically shows a partial cut-away side view of some of the components of the two pole circuit breaker in a tripped position.

If an overcurrent occurs, the bimetal beam 13 will bend toward the upper portion 23 of common trip 17, and after making contact therewith will exert a force sufficient to disengage the lower portion 25 of the common trip 17 from the latch portion 26 of cam 27. This allows the latch portion 26 of the cam 27 to rotate and release the holding force on the rocker actuator 33 exerted by the over center rocker position. The rocker return spring 53 will then return the rocker actuator 33 to the off position. The tripped position is shown in FIG. 7.

Figure 8:
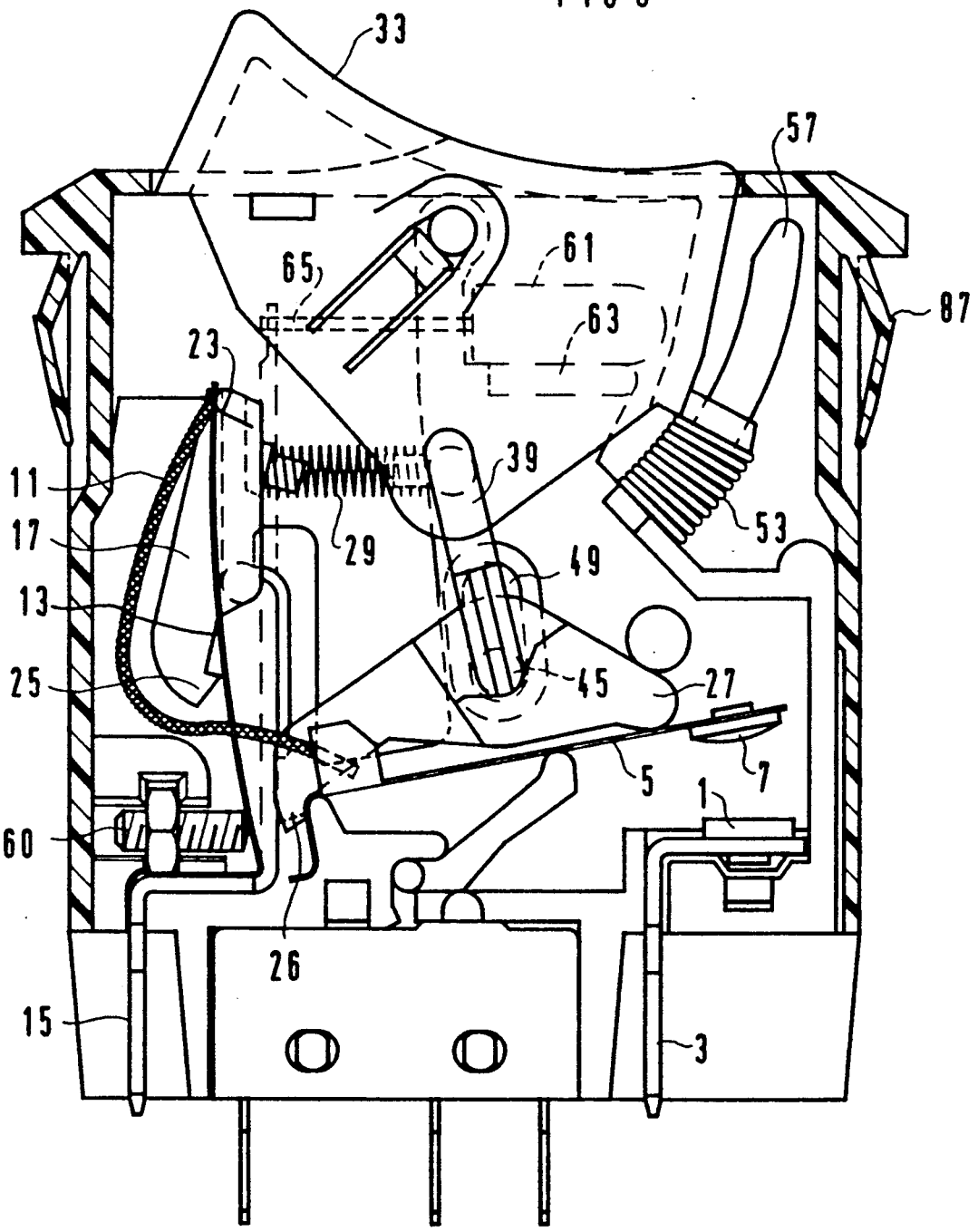
FIG. 8 shows a side view of the two pole circuit breaker in a trip free position.

FIG. 8 shows the circuit breaker when the rocker actuator 33 is held in the on position. This feature is referred to as the trip free position.

While specific embodiments of the invention have been described and illustrated, it will be clear that variations in the details of the embodiments specifically illustrated and described may be made without departing from the true spirit and scope of the invention as defined in the appended claims. For example, while a 2 pole circuit breaker with a sensing capability at both poles has been described, only one of the poles could have a sensing capability. In this case, one of the bimetal beams 13 would be eliminated and the corresponding cantilever spring 5 would either be directly connected to the stationary contact member 1 or to the flexible conductor 11.

What is claimed is:

1. A device comprising:

a frame having a first projection extending therefrom;

a rocker actuator having a yoke portion extending therefrom; and means for pivotally connecting said rocker actuator to said frame;

such that said rocker actuator is movable between a first position and a second position and such that said first projection passes through said yoke portion and guides and centers said rocker actuator on said frame during movement between said first and second positions.

2. A device according to claim 1, further including a spring disposed around said first projection and between said frame and said yoke portion, said spring biasing said rocker actuator toward said second position.

3. A device according to claim 2, wherein said pivotally connecting means includes means for allowing said rocker actuator to snappingly engage onto said frame when said rocker actuator is pushed onto said frame.

4. A device according to claim 3, wherein said allowing means includes a partial circular cutout in a wall of said rocker actuator and a flexible cantilevered beam which extends toward and closes an open end of said partial circular cutout.

5. A device according to claim 4, wherein said means includes a second projection extending from said frame, and said flexible cantilevered beam flexes in response to engagement with said second projection when said rocker actuator is pushed onto said frame, and said flexible cantilevered beam snaps back to its original position when said second projection enters said partial circular cutout thereby retaining said second projection in said partial circular cutout.

6. A device according to claim 5 wherein a groove exists on an inner surface of said wall, said groove adapted to receive and guide said second projection into said partial circular cutout.

7. A device according to claim 6, further comprising a common trip having a cylindrical projection, said cylindrical projection snappingly engages within a partial circular opening in said frame when pushed therein such that said cylindrical projection is free to pivot within said partial circular opening.

8. A device according to claim 7, wherein the diameter of said cylindrical projection and the diameter of said partial circular opening are equal, and said partial circular opening extends more than 180°.

9. A device according to claim 8, further comprising:

a cam having a latch projection;

a rocker link connecting said rocker actuator to said cam, said rocker link having first and second means, for pivotally and snappingly engaging said rocker link to said rocker actuator and said cam, respectively.

10. A device according to claim 9, wherein said first means includes a split cylindrical projection which extends from said rocker link into an opening in said rocker actuator, said second means includes a cylindrical projection extending from said rocker link which passes through an opening in said cam and into a slot defined in said frame, said cam being free to pivot about said rocker link cylindrical projection.

11. A device according to claim 1, further comprising first and second contact members, at least one of said first and second contact members being operatively connected to said rocker actuator such that when said rocker actuator is in said first position said first and second contact members engage with each other, and when said rocker actuator is in said second position said first and second contact members are separated from each other.

12. A device comprising:

a frame having a pair of cylindrical projections extending therefrom and;

a rocker actuator having a pair of partial circular cutouts in a sidewall thereof and a pair of cantilevered flexible beams each having a free end which extends toward a respective one of said partial circular cutouts such that as said rocker actuator is pushed onto said frame, said flexible cantilevered beams flex and a respective one of said cylindrical projections enters into a respective one of said partial circular cutouts, whereby upon entering said respective one of said partial circular cutouts said cylindrical projections are retained therein by a respective one of said flexible cantilevered beams allowing said rocker actuator to pivot freely around said cylindrical projections.

13. A device according to claim 12 wherein said rocker actuator is movable into first and second positions; and further comprising means for guiding and aligning said rocker actuator along a path between said first and second positions; and means for guiding said cylindrical projections into said partial circular cutouts when said rocker actuator is pushed onto said frame.

14. A device according to claim 12, wherein said rocker actuator is a single molded piece of opaque plastic.

15. A device according to claim 12, wherein said rocker actuator is a single molded piece of transparent plastic.

16. A device according to claim 13, further comprising first and second contact members, at least one of said first and second contact members being operatively connected to said rocker actuator such that when said rocker actuator is in said first position said first and second contact members engage with each other, and when said rocker actuator is in said second position said first and second contact members are separated from each other.

17. A method for assembling a device comprising the steps of:

a. inserting a cylindrical projection which extends from a common trip into a partial circular cutout in a frame;

b. snappingly engaging a first projection which extends from a rocker link into a corresponding hole in a rocker actuator to pivotally engage said rocker link to said rocker actuator;

c. snappingly engaging a second projection which extends from said rocker link into a corresponding opening in a cam;

d. sliding said rocker actuator onto a projection extending from said frame;

e. flexing a flexible cantilevered beam disposed in a sidewall of said rocker actuator;

f. guiding said frame projection along said flexible cantilevered beam; and g. snapping said frame projection into a partial circular cutout in a sidewall of said rocker actuator.

18. A switch comprising:

a frame having a first projection extending therefrom;

a rocker actuator having a yoke portion extending therefrom;

means for pivotally connecting said rocker actuator to said frame such that said rocker actuator is movable between a first position and a second position and such that said first projection passes through said yoke portion and guides and centers said rocker actuator on said frame during movement between said first and second positions;

first and second contact members, wherein at least one of said first and second contact members are operatively connected to said rocker actuator such that when said rocker actuator is in said first position said first and second contact members engage with each other and when said rocker actuator is in said second position said first and second contact members are separated from each other; and means for tripping said rocker actuator from said first position into said second position.

19. A switch according to claim 18, wherein said frame has a pair of cylindrical projections extending therefrom, and said rocker actuator has a pair of partial circular cutouts in a sidewall thereof and a pair of cantilevered flexible beams each having a free end which extends toward a respective one of said partial circular cutouts such that as said rocker actuator is pushed onto said frame, said flexible cantilevered beams flex and a respective one of said cylindrical projections enters into one of said partial circular cutouts, whereby upon entering said respective one of said partial circular cutouts said cylindrical projections are retained therein by a respective one of said flexible cantilevered beams allowing said rocker actuator to pivot freely around said cylindrical projections.

20. A switch according to claim 18, wherein said means for tripping includes (1) a bimetal beam operatively connected to a corresponding one of said first and second contact members and (2) a common trip which is linked to said rocker actuator such that when said bimetal beam bends in response to being heated, said bimetal beam moves said common trip such that said rocker actuator is forced to move from said first position to said second position.

* * * * *

UNITED STATES PATENT AND TRADEMARK OFFICE

CERTIFICATE OF CORRECTION

PATENT NO. : 5,223,813

DATED : June 29, 1993

INVENTOR(S) : Bordui, et al

It is certified that error appears in the above-indentified patent and that said Letters Patent is hereby corrected as shown below:

Column 6, line 19, after "said" insert --allowing--.

Signed and Sealed this

Tenth Day of May, 1994

*Attest:*

*Attesting Officer*

BRUCE LEHMAN

*Commissioner of Patents and Trademarks*